US010155297B2

(12) United States Patent
Chen et al.

(10) Patent No.: US 10,155,297 B2
(45) Date of Patent: Dec. 18, 2018

(54) CHEMICAL MECHANICAL POLISHING HEAD

(71) Applicant: Taiwan Semiconductor Manufacturing Co., Ltd., Hsin-Chu (TW)

(72) Inventors: Jerry Chen, Hsinchu County (TW); Chunhung Chen, Youngjing (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 115 days.

(21) Appl. No.: 15/205,367

(22) Filed: Jul. 8, 2016

(65) Prior Publication Data

US 2018/0009077 A1 Jan. 11, 2018

(51) Int. Cl.
*B24B 37/20* (2012.01)

(52) U.S. Cl.
CPC ..... *B24B 37/20* (2013.01)

(58) Field of Classification Search
CPC ..... B24B 37/20; B24B 37/27; B24B 37/32; B24B 37/12; B24B 37/16; B24B 37/04; B24B 37/30; B24B 13/005; B24B 19/226; B24B 41/06
See application file for complete search history.

(56) References Cited

U.S. PATENT DOCUMENTS 5,762,539 A * 6/1998 Nakashiba ..... B24B 37/30 451/285
6,056,632 A * 5/2000 Mitchel ..... B24B 37/30 451/286
6,179,956 B1 * 1/2001 Nagahara ..... B24B 37/30 156/345.14
6,443,821 B1 * 9/2002 Kimura ..... B24B 37/30 348/231.6
9,604,339 B2 * 3/2017 Duescher ..... B24B 37/20
2008/0293342 A1 * 11/2008 Yu ..... B24B 37/30 451/288

* cited by examiner

*Primary Examiner* — Dung Van Nguyen
(74) *Attorney, Agent, or Firm* — Eschweiler & Potashnik, LLC

(57) ABSTRACT

To provide improved planarization, techniques in accordance with this disclosure include a CMP station that includes a support plate having a plurality of apertures. An aperture of the plurality of apertures has a first opening and a second opening connected by a slot. Other systems and methods are also disclosed.

20 Claims, 6 Drawing Sheets

CHEMICAL MECHANICAL POLISHING HEAD

BACKGROUND

Over the last four decades, the density of integrated circuits has increased by a relation known as Moore's law. Stated simply, Moore's law says that the number of transistors on integrated circuits (ICs) doubles approximately every 18 months. Thus, as long as the semiconductor industry can continue to uphold this simple "law," ICs double in speed and power approximately every 18 months. In large part, this remarkable increase in the speed and power of ICs has ushered in the dawn of today's information age.

Unlike laws of nature, which hold true regardless of mankind's activities, Moore's law only holds true only so long as innovators overcome the technological challenges associated with it. One of the advances that innovators have made in recent decades is to use chemical mechanical polishing (CMP) to planarize layers used to build up ICs, thereby helping to provide more precisely structured device features on the ICs.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1A:
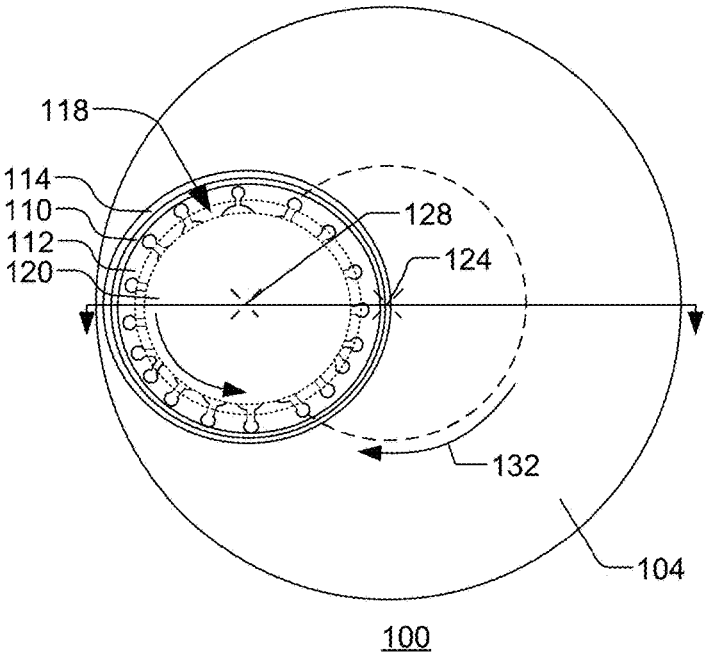
FIG. 1A shows top view of a CMP system having a polishing head in accordance with some embodiments.

The present disclosure provides many different embodiments, or examples, for implementing different features of this disclosure. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 1B:
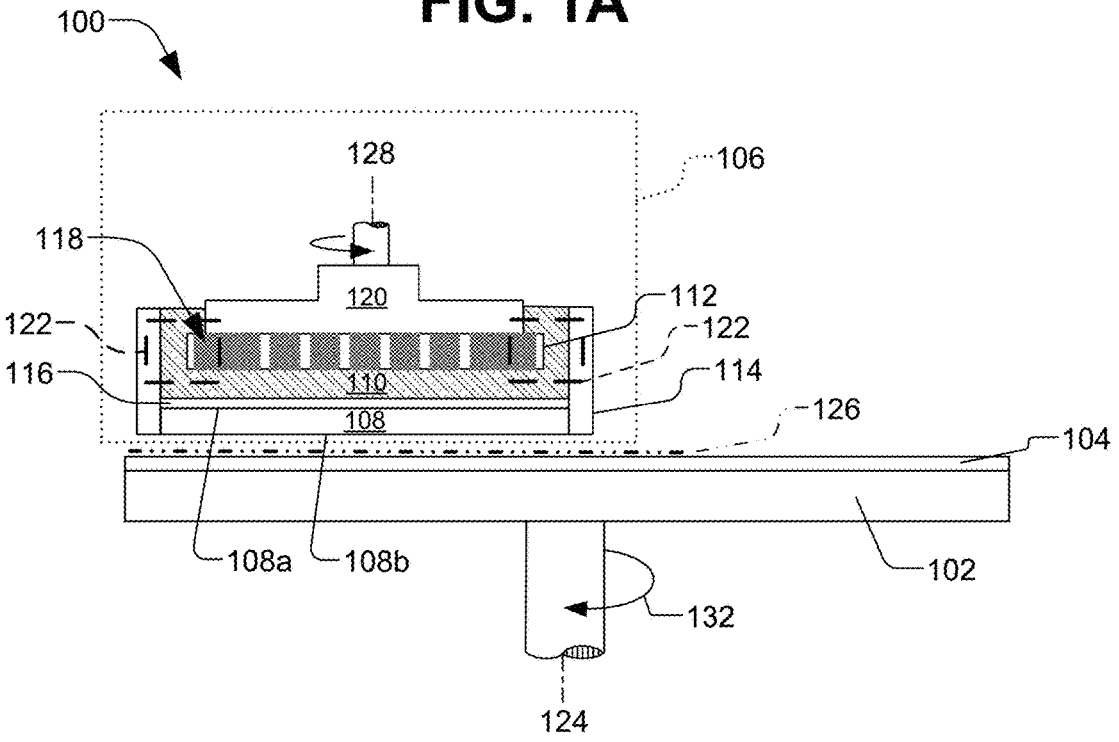
FIG. 1B is a cross sectional view illustrating a wafer being polished by the CMP system and the polishing head of FIG. 1A in accordance with some embodiments.

FIGS. 1A-1B show a top view and cross-sectional side view, respectively, of a CMP station 100 in accordance with some embodiments. The CMP station 100 comprises a platen 102, polishing pad 104, and a polishing head 106. The polishing pad 104 is supported by the platen 102. The polishing head 106 is adapted to hold a wafer 108 on the polishing pad 104 during polishing. In particular, the polishing head 106 holds the wafer 108 against the polishing pad 104 as the platen 102 rotates as shown by arrow 132.

The polishing head 106 includes a membrane 110, a support plate 112, and a retaining ring 114. Together, the membrane 110, the support plate 112, and the retaining ring 114 form a pocket 116 adapted to retain the wafer 108. The position of the wafer 108 in the pocket 116 and accordingly the force with which the wafer 108 is pressed against the polishing pad 104 can be controlled by the amount of pressure exerted on the wafer 108 in the pocket 116. Pressure is exerted on the wafer 108 via a plurality of apertures 118 in the support plate 112 and the retaining ring 114.

The plurality of apertures 118 are openings in the support plate 112. Typically, the plurality of apertures 118 are centrally distributed over the support plate 112. When the wafer 108 is inside the pocket 116, the wafer 108 is flush with the retaining ring 114. A pressure control 120 exerts a pressure through the plurality of apertures 118 to a backside 108*a* of the wafer 108 that causes the wafer 108 to be held in the pocket 116 and a front-side 108*b* of the wafer 108 to be in contact with the polishing pad 104.

In one embodiment, the pressure control 120 is a single element. In another embodiment, the pressure control 120 includes a plurality of variable-pressure elements on the polishing head 106. The pressure elements, which are proximate to pocket 116, may exert independent amounts of suction or pressure on the backside 108*a* of the wafer 108 through corresponding apertures of the plurality of apertures 118. The pressure control 120 may exert a negative pressure to hold the wafer 108 higher in the pocket 116 or exert a positive pressure to push the front-side 108*b* of the wafer 108 against the polishing pad 104.

The plurality of apertures 118 affects the uniformity of the polishing of the wafer 108 because the pressure disproportionately affects areas underlying the plurality of apertures 118. Suppose that the pressure control 120 is adjusted in order to achieve a desired wafer thickness. For example, the pressure may be selected in order to exert enough force through the plurality of apertures 118 to cause the wafer 108 to be forced down on the polishing pad 104 thereby being planarized to a predetermined degree.

Because pressure is distributed primarily to the areas of the backside 108*a* of the wafer 108 underlying the plurality of apertures 118, the areas on the front-side 108*b* corresponding to the areas of the backside 108*a* are polished to the desired thickness. However, remaining areas, not underlying an aperture, may be subjected to more or less polishing depending on the applied pressure, such that those remaining areas of the wafer 108 have a different wafer thickness that is not desired. For example, typically areas at an outermost edge of the wafer 108 may receive less pressure than more central regions of the wafer 108. Accordingly, during the polishing, a ridge hump may form on the outermost edge of the wafer 108.

To avoid an undesired wafer thickness, the plurality of apertures 118 have a shape and position that causes the pressure from the pressure control 120 to be more evenly distributed over the wafer 108. For example, the plurality of apertures 118 are arranged in the circumferential edge region 122 of the support plate 112. Accordingly, the pressure from pressure control 120 is distributed more evenly across the backside 108*a* of the wafer 108 such that the polishing is performed more evenly across the wafer 108 to the outermost edge.

Figure 2:
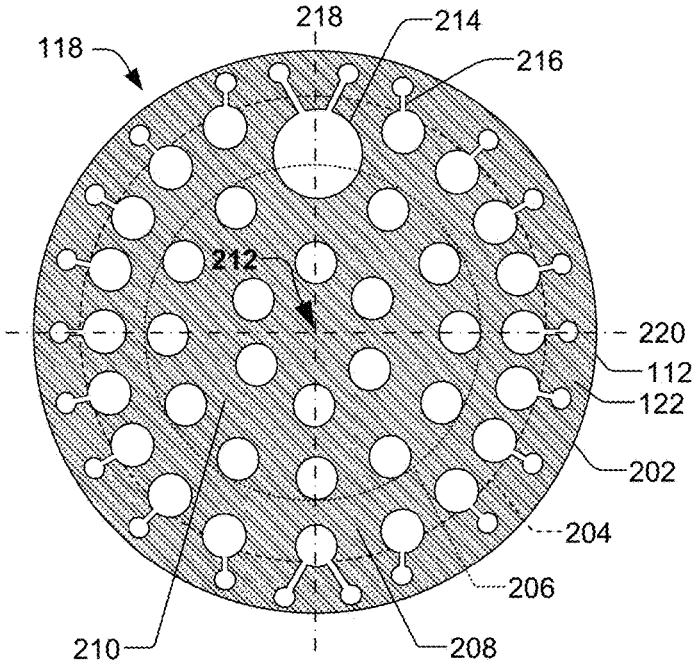
FIG. 2 is a top view of FIGS. 1A and 1B's support plate having a plurality of apertures in accordance with some embodiments.

FIG. 2 shows a support plate 112 having apertures that include a plurality of apertures 118 that have openings in a circumferential edge region 122 defined as the area between an outermost edge 202 to dashed circle 204 of the support plate 112. In one embodiment, the circumferential edge region 122 is a portion of the area radially extending inward from the outermost edge 202 of the support plate 112. For example, the circumferential edge region 122 may be defined to account for 20% of the total area of the support plate 112. In another embodiment, the circumferential edge region 122 may correspond to a length of the membrane 110 extending over a top surface the support plate 112, as shown in FIG. 1B. For example, the membrane 110 may extend over an uppermost surface of the support plate. The circumferential edge region 122 may correspond to the area underlying the portion of the membrane 110 on the uppermost surface of the support plate 112.

Figure 3:
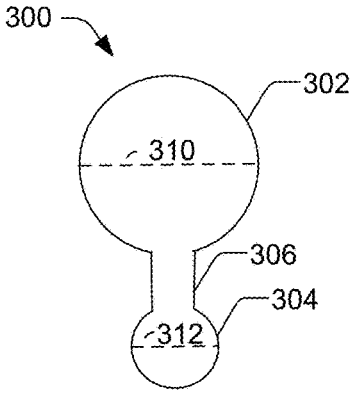
FIG. 3 illustrates an example aperture for use on a support plate in accordance with some embodiments.

FIG. 3 is an illustration of an aperture 300 of the plurality of apertures 118. The aperture 300 includes a first opening 302 and a second opening 304 connected by a slot 306. The first opening 302 has a first diameter 310 and the second opening 304 has a second diameter 312. In some embodiments, the first diameter 310 is larger than the second diameter 312.

While the first opening 302 and the second opening 304 are illustrated as generally circular, the first opening 302 and second opening 304 may be any number of shapes, such as elliptical, triangular, rectangular, etc. Likewise, rather than the first opening 302 and the second opening 304 being connected by the slot 306, the first opening 302 and the second opening 304 may be connected to one another without the intermediary of the slot 306. In another embodiment, the first opening 302 and the second opening 304 may form a single ellipse or other shape. In these alternative embodiments, regardless of the shape of the apertures, at least a portion of the aperture 300 is positioned in the circumferential edge region 122 of the support plate 112.

Returning to FIG. 2, the plurality of apertures 118 or a subset of the plurality of apertures 118 may be arranged such that either the first opening 302 or the second opening 304 is positioned in the circumferential edge region 122. For example, the second opening 304 may be adjacent the outermost edge 202 of the support plate 112. While one opening of the aperture 300 may be in the circumferential edge region 122, the other opening of the aperture may be positioned in an intermediary region 208. The intermediary region 208 is defined as the area between the dashed circle 204 and the dotted circle 206. In particular, the first opening 302 and/or the second opening 304 may be arranged such that at least a portion of the first opening 302 is arranged in the intermediary region 208 and/or the second opening 304 is in the circumferential edge region 122 of the support plate 112.

In addition to the branched apertures in the circumferential edge region 122 and the intermediary region 208, there are circular apertures in a central region 210. The central region 210 is defined as the area from a center 212 of the support plate 112 to the dotted circle 206. Accordingly, the plurality of apertures may include different types of apertures. For example, large aperture 214 has a first opening connected to a second opening and a third opening via slots. Furthermore, large aperture 214 extends into each of the regions on the support plate 112, including the circumferential edge region 122, the intermediary region 208, and the central region 210. In another example, the slots of apertures in the plurality of apertures 118 generally extend radially. However, one or more slots may extend at a different angle. For example, the slot of aperture 216 extends in a direction parallel with an axis 218. In some embodiments, all the apertures (e.g., first openings 302) can be of equal size, except for the large aperture 214 which can be larger than the first openings 302 and the second openings 304 which can be smaller than the first openings 302. In some embodiments, the large aperture 214 can have a size that is more than twice the size of the first openings 302, and the second openings 304 can be less than half the size of the first openings 302.

In addition to different types of apertures, the arrangement of the apertures on the support plate 112 may be different based on the desired polishing to be performed by the polishing head 106. In one embodiment, the plurality of apertures 118 may be symmetric about an axis 218. Likewise, the plurality of apertures 118 may be generally symmetric about the axis 220. In another embodiment, the apertures may be arranged based on a desired polished profile of the wafer 108.

Referring back to FIGS. 1A and 1B, in some CMP processes, the wafer 108 is held inside the pocket 116 with upward suction applied to a backside 108*a* of the wafer 108 by pressure control 120 so as to keep the wafer 108 raised above the lower face of retaining ring 114. The platen 102 is then rotated about a platen axis 124, which correspondingly rotates the polishing pad 104. A slurry 126 may then be dispensed onto the polishing pad 104. A spindle motor (not shown) then begins rotating polishing head 106 around spindle axis 128. Meanwhile, the polishing head 106 is lowered and is pressed onto the polishing pad 104, with the wafer 108 recessed just long enough for the polishing head 106 to reach polishing speed.

When the polishing head 106 reaches wafer polishing speed, the pressure control 120 causes a positive and/or negative pressure to be applied to the membrane 110. Under positive pressure, the membrane 110 exerts a force on the backside 108*b* of the wafer 108 such that the wafer 108 is lowered inside pocket 116 and the front side surface 108*a* contacts the surface of polishing pad 104 and/or the slurry 126. Due to the force exerted by the membrane 110, the wafer 108 is substantially flush with and constrained outwardly by retaining ring 114. The force exerted on the wafer 108 by the retaining ring 114 can likewise be varied by the pressure control 120 to cause the wafer 108 to be positioned in the pocket 116 in a particular manner.

The retaining ring 114 and wafer 108 continue to spin relative to polishing pad 104, which is rotating along with the platen 102. This dual rotation, in the presence of the downforce applied to wafer 108 and the slurry 126, cause the wafer 108 to be gradually planarized. The wafer 108 is subjected more uniform polishing due to a portion of apertures in the plurality of apertures 118 being positioned in the circumferential edge region 122 of the support plate 112.

Figure 4:
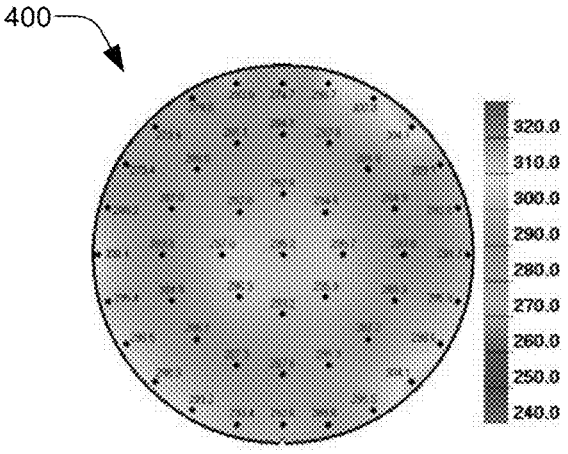
FIG. 4 shows a uniformity map associated with a wafer having been polished by a CMP system in accordance with some embodiments.

FIG. 4 shows a uniformity map associated with a wafer having been polished by the CMP system in accordance with some embodiments. As discussed above, an edge hump can form on the outermost edge of the wafer 108 such that the outermost edge of the wafer 108 is thicker than more central regions of the wafer 108. The hump occurs because centrally located apertures do not evenly distribute the support the membrane pressure radially. In particular, the membrane pressure exerted by the pressure control 120 does not reach portions of the membrane 110 overlying the outermost edge of the wafer 108 through the support plate 112 because there are not apertures overlying the outermost edge of the wafer 108.

However, the plurality of apertures 118 have, for example, a second opening 304 adjacent the outermost edge 202 of the support plate 112 which overlies the outermost edge of the wafer 108. Accordingly, the membrane 110 receives more uniform pressure from the pressure control 120. Thus, the membrane 110 more uniformly exerts pressure on the backside 108*a* of the wafer 108, thereby causing the wafer 108 to uniformly contact the surface of polishing pad 104 and/or slurry 126. The uniformity map 400 of the surface of the wafer 108, illustrates that the wafer is more uniformly planarized such that there is not an edge hump about the outermost edge of the wafer 108. For example, the illustrate wafer has a substantially uniform thickness of between about 280 units and about 310 units over its face, which is a significant improvement over some previous CMP approaches.

Figure 5:
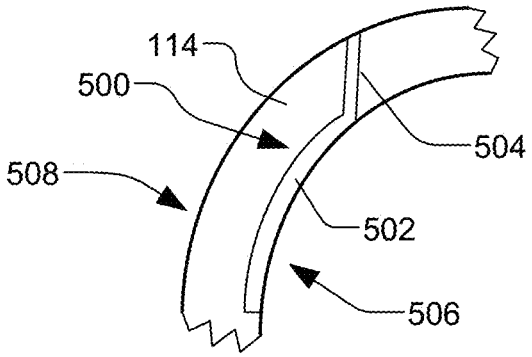
FIG. 5 illustrates an example retaining ring for use in a polishing head in accordance with some embodiments.

FIG. 5 illustrates an example portion of a retaining ring 114 for use in a polishing head 106 in accordance with some embodiments. The portion of the retaining ring 114 has a trench 500 having an inner trench 502 and a radial trench 504. The inner trench 502 is positioned along an inner edge 506 of the retaining ring 114. The radial trench 504 extends from the inner edge 506 to the outer edge 508 of the retaining ring 114. In one embodiment, the radial trench 504 extends along a radius of the retaining ring. Alternatively, the radial trench 504 may extend at angle relative to the radius.

The retaining ring 114 surrounds a vertical edge of the wafer 108. The vertical edge of the wafer 108 is adjacent an outermost edge region on the backside 108*a* of the wafer 108. The vertical edge is perpendicular to the outermost edge region of the wafer 108. The trench 500 is adapted to allow the retaining ring 114 to exert a ring pressure on the vertical edge of the wafer 108 as discussed above with respect to FIGS. 1A and 1B. In one embodiment, the retaining ring 114 receives the ring pressure from the pressure control 120. In another embodiment, the retaining ring 114 may receive the ring pressure from an alternative or independent source such that a pressure, different from the pressure being exerted on the support plate 112, can be applied to the retaining ring 114.

Rather than only having a radial trench 504 that exerts the ring pressure at a point on the vertical edge of the wafer 108, the trench 500 includes the inner trench 502. The inner trench 502 distributes the ring pressure across a larger area of the vertical edge of the wafer 108. The length of the inner trench 502 along the inner edge 506 of the retaining ring 114 may be defined to cover a percentage of the inner edge 506 of the retaining ring. For example, the inner trench 502 may be adapted to cover 5-10% of the inner edge 506. In one embodiment, a plurality of trenches may be positioned along the retaining ring 114. Accordingly, the retaining ring 114 is subject to pressure that changes the position of the wafer 108 in the pocket 116.

Figure 6:
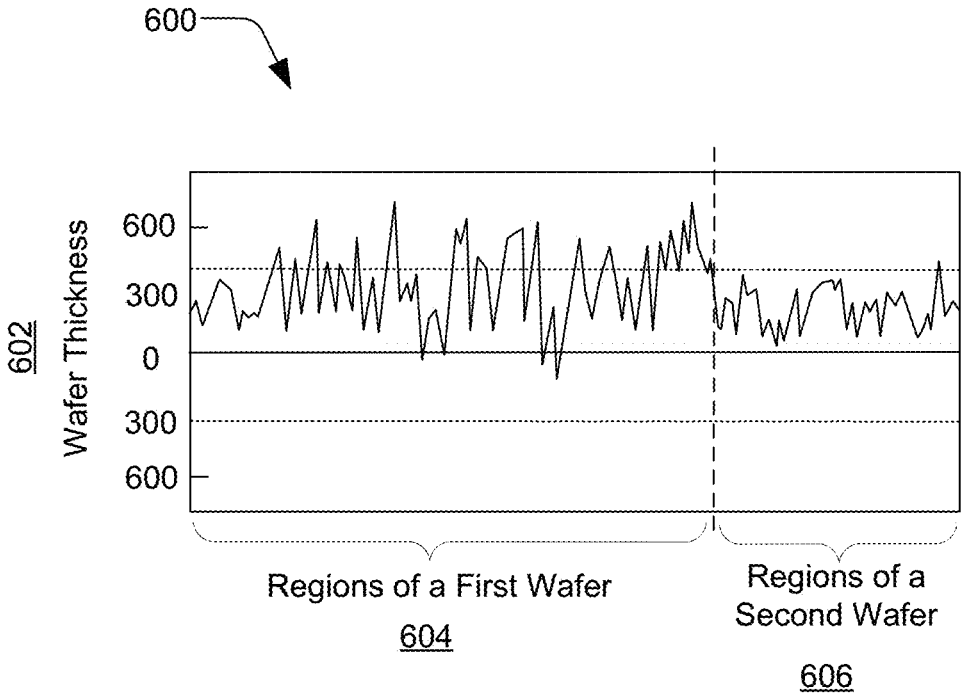
FIG. 6 is a chart illustrating wafer thickness in accordance with some embodiments.

FIG. 6 shows a graph 600 illustrating one manner in which the wafer can be polished. As the upper conductive surface is polished, its wafer thickness 602 is reduced over time and corresponding profiles are measured. Consider a first wafer 604 that is polished using support plate having a centrally located apertures. The first wafer 604 is polished until the desired thickness is reached. However, as can be seen, the regions of the first wafer 604 are less uniform than corresponding regions of a second wafer 606.

Conversely a second wafer 606 is polished using a polishing head having a plurality of apertures 118. The plurality of apertures 118 are arranged on the support plate such that at least a portion of an opening is located in a circumferential edge region 122 of the support plate 112. Throughout this polishing, the pressure being applied to the membrane 110 through the plurality of apertures 118 can be independently changed to limit height variation between neighboring wafer surfaces. For example, if a wafer surface is high relative to its neighboring to-be-polished wafer surfaces, the pressure control 120 can increase pressure (and/or pressure applied to the neighboring wafer surfaces can be decreased). Accordingly, the wafer 108 can be polished selectively due to the variable pressure. Because the plurality of apertures 118 allows pressure to be more uniformly distributed across the wafer 108, the end result of polishing is a more uniformly polished wafer 108. Accordingly, the second wafer 606 has a more uniform thickness.

Figure 7:
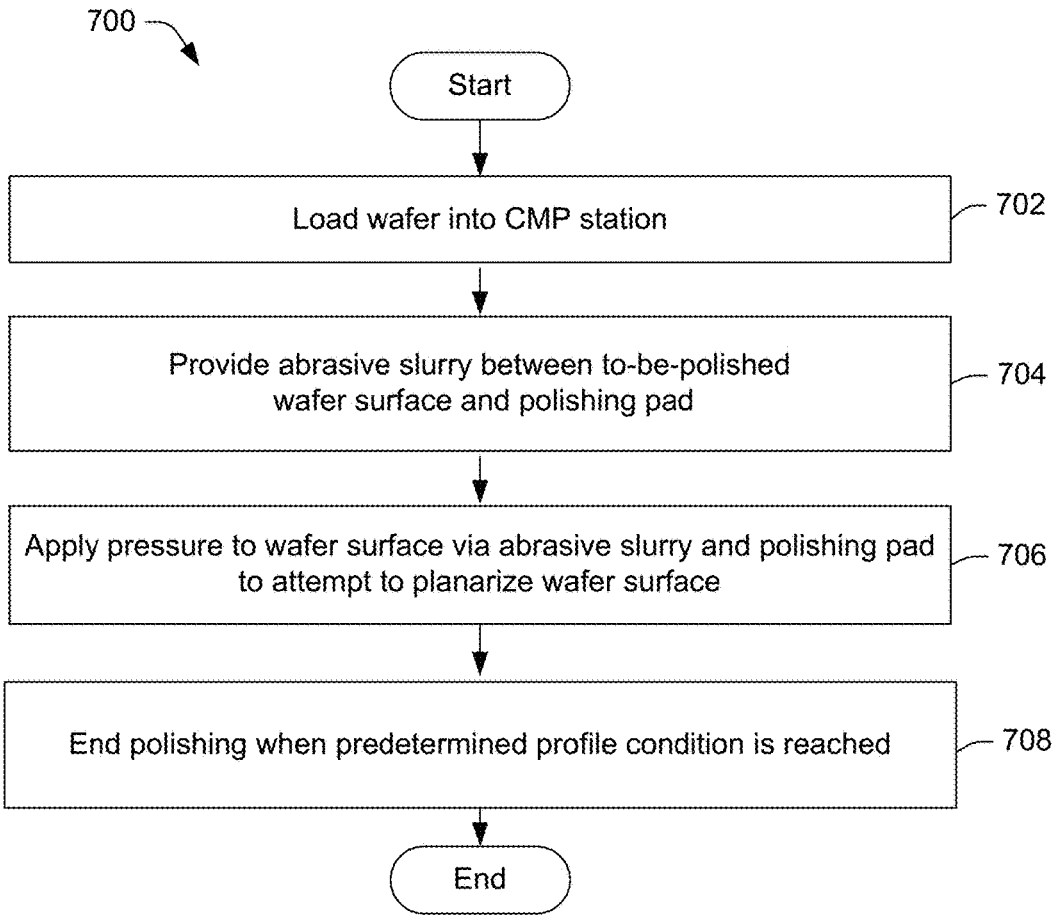
FIG. 7 is a flow diagram illustrating a method of performing a planarization process in accordance with some embodiments.

FIG. 7 illustrates another method of planarization in accordance with some embodiments of the present disclosure. While this method and other methods disclosed herein may be illustrated and/or described as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the disclosure herein. Further, one or more of the acts depicted herein may be carried out in one or more separate acts and/or phases.

As FIG. 7 shows, method 700 starts at 702 when a wafer 108 is loaded onto the CMP station 100. As previously alluded to, the CMP station planarizes wafers (or wafer structures) as part of an overall wafer fabrication process. The wafer 108 is retained in the pocket 116 of the polishing head 106. As discussed above, the polishing head 106 includes the membrane 110, the support plate 112, and the retaining ring 114. In some embodiments, the wafer 108 can be a bulk silicon wafer or a semiconductor-on-insulator (SOI) wafer (e.g., silicon on insulator wafer). The wafer 108 may also be a silicon carbide (SiC) wafer, silicon germanium (SiGe) wafer, a binary semiconductor wafer (e.g., GaAs), a tertiary semiconductor wafer (e.g., AlGaAs), a higher order semiconductor wafer, or even a sapphire wafer. The wafer can include doped regions formed in or on the wafer, epitaxial layers formed in or on the wafer, insulating layers formed in or on the wafer, photoresist layers formed in or on the wafer, and/or conducting layers formed in or on the wafer. In many instances, the wafer can have a diameter of 1-inch (25 mm); 2-inch (51 mm); 3-inch (76 mm); 4-inch (100 mm); 5-inch (130 mm) or 125 mm (4.9 inch); 150 mm (5.9 inch, usually referred to as a "6 inch"); 200 mm (7.9 inch, usually referred to as "8 inch"); 300 mm (11.8 inch, usually referred to as "12 inch"); or 450 mm (17.7 inch, usually referred to as "18 inch"); for example.

In step 704, the method provides a slurry 126 between a wafer surface and a polishing pad. In some embodiments, the slurry 126 is an abrasive slurry that is a friction reducing agent. In another embodiment, the slurry 126 may be an abrasive-free slurry, which can significantly reduce scratching in a polishing or buffing operation.

In 706, the method applies pressure to the backside 108*a* of the wafer 108 via the plurality of apertures 118 on the support plate 112. In one embodiment, the pressure is exerted by a plurality of pressure elements of the pressure control 120. The pressure elements correspond to apertures of the plurality of apertures 118 on the support plate 112. The pressure elements are controlled individually to control the amount of pressure being exerted through individual apertures to the membrane 110. Accordingly, the distribution of the pressure on the backside 108*a* of the wafer 108 can be controlled by altering the pressure exerted by the pressure elements of the pressure control 120.

In 708, polishing for the wafer 108 ends when a surface profile indicates that the wafer 108 has reached the desired thickness. Often, this corresponds to a condition where the upper conductive layer on the wafer reaches a predetermined thickness.

Figure 8:
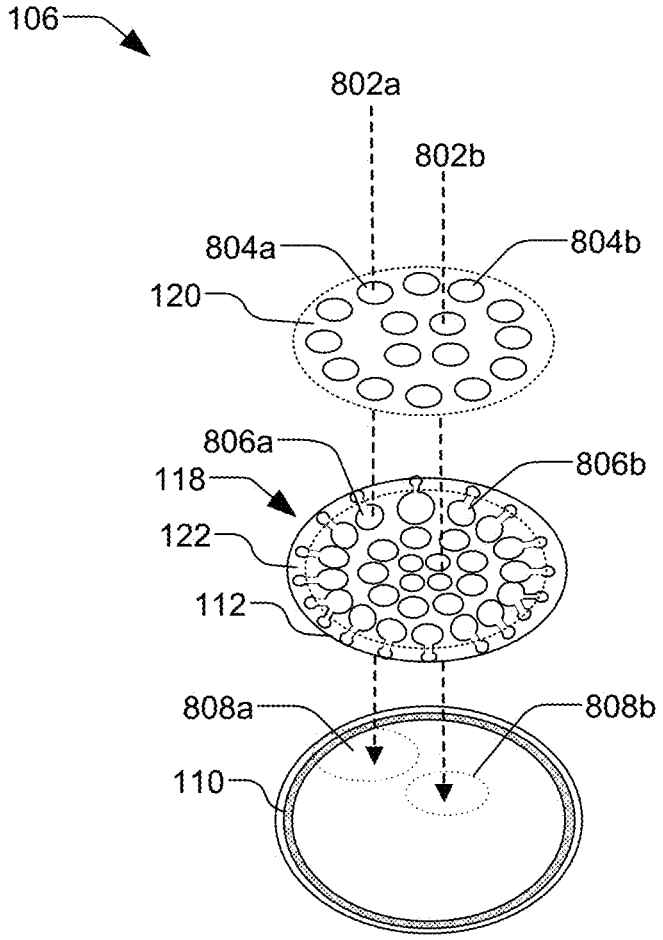
FIG. 8 is an exploded view illustrating a polishing head having a plurality of pressure elements in accordance with some embodiments.

FIG. 8 is an exploded cross sectional view illustrating a polishing head having a plurality of pressure elements in accordance with some embodiments. The polishing head 106 operates in a similar manner as described above with respect to FIGS. 1A and 1B. For example, the polishing head 106 includes the pressure control 120 over the support plate 112 having a plurality of apertures 118, which is over the membrane 110. Pressure can be exerted through the pressure control 120, the support plate 112, to the membrane along a first axis 802*a* and a second axis 802*b*.

As discussed above with respect to FIG. 7, the pressure control 120 may have a plurality of pressure elements 804*a* and 804*b*. For example, a first pressure element 804*a* can exert a first pressure and a second pressure element 804*b* can exert a second pressure. In one embodiment, the first pressure is different from the second pressure. The pressure elements may be able to exert variable pressure that is controlled from the pressure control 120. The amount of pressure being exerted by the pressure control 120 may correspond to a location of the pressure element with respect to a region on the wafer.

The first pressure element 804*a* is arranged over a first aperture 806*a* of the plurality of apertures 118 such that the pressure is applied to a first membrane region 808*a*. The second pressure element 804*b* is arranged over a second aperture 806*b* of the plurality of apertures 118 such that the pressure is applied to a second membrane region 808*b*. As discussed above with respect to FIG. 2, the shape of the apertures in the circumferential edge region 122 distributes the pressure from the pressure control 120 to the edge of the membrane 110 and accordingly to the edge of the wafer 108.

Because apertures in the plurality of apertures 118 have openings in the circumferential edge region 122, the plurality of apertures 118 may distribute more pressure than centrally located apertures such as 806*b*. Accordingly, the plurality of apertures 118 in the circumferential edge region 122 may require a higher rate of pressure than centrally located apertures. Therefore, the first pressure element 804*a*, positioned over the first aperture 806*a* (circumferential) may exert more pressure than the second pressure element 804*b* positioned over the second aperture 806*b* (central). The first and the second pressure may be varied to achieve the desired uniformity. Accordingly, the wafer 108 is subjected more uniform polishing due to a portion of apertures in the plurality of apertures 118 being positioned in the circumferential edge region 122 of the wafer 108 and a pressure differential.

Figure 9:
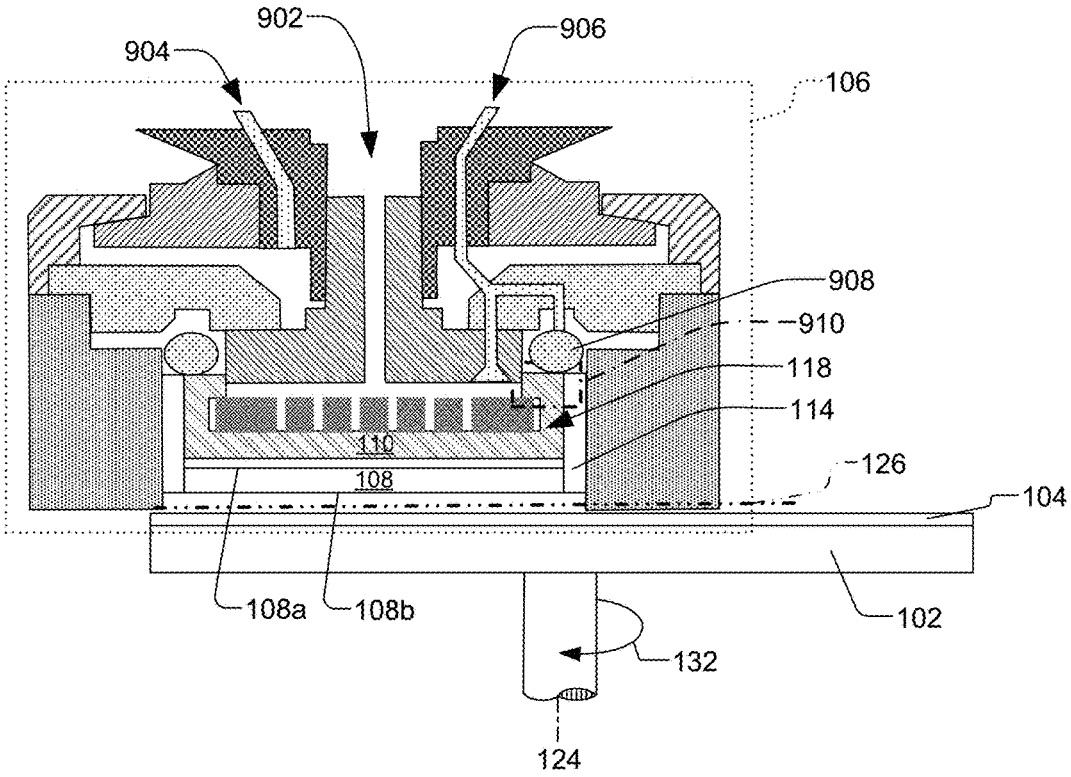
FIG. 9 is a cross sectional view illustrating a wafer being polished by the CMP system and the polishing head having multiple pressure intakes in accordance with some embodiments.

FIG. 9 is a cross sectional view illustrating a wafer being polished by the CMP system and the polishing head having multiple pressure intakes in accordance with some embodiments. The polishing head 106 operates in a similar manner as described above with respect to FIGS. 1A and 1B. As described above, the membrane 110 receives membrane pressure 902 through the plurality of apertures 118 of the support plate 112. As described above with respect to FIG. 5, the retaining ring 114 receives the retaining ring pressure 904 such that the retaining ring 114 is able to apply the retaining ring pressure 904 to the wafer 108.

In addition to the membrane pressure 902 and the retaining ring pressure 904, an inner-tube pressure 906 may be applied to an inner-tube 908. The inner-tube 908 is positioned over an overhang 910 of the membrane 110 that overlies the support plate 112. When the inner-tube 908 receives pressure from the inner-tube pressure 906, the inner-tube 908 exerts a downward force on the overhang 910 of the membrane 110, which is transmitted though the support plate 112 to an outermost edge of the wafer 108. Accordingly, additional pressure(s) can be applied to the edge of the wafer 108 to combat the formation of a ridge hump.

In one embodiment, the CMP system is shown. The chemical mechanical polishing system includes a polishing head adapted to retain a wafer. The polishing head includes a support plate having a plurality apertures. An aperture of the plurality of apertures has a first opening and a second opening connected by a slot.

In one embodiment, a polishing head associated with the CMP system is shown. The polishing head includes a retaining ring and a support plate attached to the retaining ring. The support plate includes a plurality apertures. An aperture of the plurality of apertures has a first opening associated with a first diameter and a second opening associated with a second diameter. The first opening and the second opening are connected by a slot.

In one embodiment, a method associated with the CMP system is shown. A wafer is loaded into a pocket of a polishing head. The polishing head includes a membrane, a support plate, and a retaining ring. A slurry is provided between a polishing pad of the CMP station and a front-side of the wafer. The wafer is polished by applying pressure from a pressure control to a backside of the wafer through a plurality of apertures on a support plate while the wafer and polishing pad 104 are moved with respect to one another.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical polishing (CMP) system, comprising:

a polishing head adapted to retain a wafer, wherein the polishing head includes a support plate having a plurality of apertures, an aperture of the plurality of apertures having a first opening and a second opening connected by a slot;

wherein the slot extends between an outer sidewall of the first opening and an outer sidewall of the second opening without passing through any portion of the first opening or the second opening.

2. The CMP system of claim 1, wherein apertures of the plurality of apertures are arranged adjacent to a circumferential edge of the support plate.

3. The CMP system of claim 1, wherein the first opening has first diameter, the second opening has a second diameter, and wherein the first diameter is larger than the second diameter.

4. The CMP system of claim 1, wherein the second opening is arranged adjacent a circumferential edge and the first opening is arranged radially inward on the support plate.

5. The CMP system of claim 1, further comprising a retaining ring, wherein the retaining ring and the support plate form a pocket adapted to surround a wafer, and wherein the retaining ring comprises a trench having an inner trench and a radial trench.

6. The CMP system of claim 5, wherein the radial trench is configured to apply pressure to an outermost edge of the wafer in the pocket.

7. The CMP system of claim 5, wherein the retaining ring is adapted to apply a ring pressure to a vertical edge of the wafer, wherein the vertical edge is approximately perpendicular to an outermost edge region on a backside of the wafer.

8. The CMP system of claim 7, wherein a membrane is adapted to apply pressure to an outermost edge of the wafer underlying a circumferential edge of the support plate.

9. The CMP system of claim 1, further comprising:

a pressure control positioned above the support plate; and a membrane positioned below the support plate, where the membrane is configured to receive a pressure from the pressure control through the plurality of apertures in the support plate.

10. A polishing head associated with a chemical mechanical polishing (CMP) system, comprising:

a retaining ring; and a support plate attached to the retaining ring, wherein the support plate includes a plurality of apertures, an aperture of the plurality of apertures having a first opening associated with a first diameter and a second opening associated with a second diameter, and wherein the first opening and the second opening are connected by a slot;

wherein the first opening has a first center point on the first diameter and the second opening has a second center point on the second diameter, the first center point being spaced apart from the second center point by a non-zero distance.

11. The polishing head associated with the CMP system of claim 10, wherein the slot is a first slot, wherein the aperture further comprises a third opening having a third diameter, and wherein the third opening is connected to the first opening by a second slot.

12. The polishing head associated with the CMP system of claim 10, wherein the first diameter is larger than the second diameter.

13. The polishing head associated with the CMP system of claim 10, wherein the plurality of apertures are positioned on the support plate such that a portion of the first opening or the second opening is in a circumferential edge region of the support plate.

14. The polishing head associated with the CMP system of claim 10, further comprising:

a retaining ring, wherein the retaining ring and the support plate form a pocket adapted to surround a wafer, and wherein the retaining ring comprises a trench having an inner trench and a radial trench.

15. The polishing head associated with the CMP system of claim 14, wherein the radial trench is configured to apply pressure to an outermost edge of the wafer in the pocket.

16. The polishing head associated with the CMP system of claim 10, further comprising:

a pressure control positioned above the support plate; and a membrane positioned below the support plate, where the membrane is configured to receive a pressure from the pressure control through the plurality of apertures in the support plate.

17. A polishing head associated with a chemical mechanical polishing (CMP) system, comprising:

a retaining ring; and a support plate attached to the retaining ring, wherein the support plate is configured with a central region and a peripheral region directly surrounding the central region, wherein the support plate includes a plurality of apertures, a first aperture of the plurality of apertures is located in the central region, wherein a second aperture of the plurality of apertures is located in the peripheral region having a first opening associated with a first diameter and a second opening associated with a second diameter, and wherein the first opening and the second opening are connected by a slot;

wherein the retaining ring and the support plate form a pocket adapted to surround a wafer, wherein the retaining ring comprises a trench having an inner trench and a radial trench, and wherein the radial trench is configured to apply pressure to an outermost edge of the wafer in the pocket.

18. The polishing head associated with the CMP system of claim 17, wherein the slot is a first slot, wherein the second aperture further comprises a third opening having a third diameter, wherein the third opening is connected to the first opening by a second slot, and wherein the first opening connected to the third opening crosses into the central region.

19. The polishing head associated with the CMP system of claim 17, further comprising:

a pressure control positioned above the support plate, wherein the pressure control includes a plurality of apertures with a plurality of pressure units, wherein a first pressure element is configured to exert a first pressure and a second pressure element is configured to exert a second pressure; and a membrane positioned below the support plate, where the membrane is configured to receive a pressure from the pressure control through the plurality of apertures in the support plate.

20. The polishing head associated with the CMP system of claim 17, wherein the first and second openings have first and second center points, respectively, and the first and second center points are different, wherein the slot extends between an outer sidewall of the first opening and an outer sidewall of the second opening.

* * * * *